US012339024B2

(12) United States Patent
Bruno et al.

(10) Patent No.: US 12,339,024 B2
(45) Date of Patent: Jun. 24, 2025

(54) EFFICIENTLY ROUTING EXCESS AIR FLOW

(71) Applicant: Trane International Inc., Davidson, NC (US)

(72) Inventors: Anthony W. Bruno, Blaine, MN (US); Aaron E. Opatz, Maple Grove, MN (US); Christopher R. Vause, Austin, TX (US)

(73) Assignee: TRANE INTERNATIONAL INC., Davidson, NC (US)

( * ) Notice: Subject to any disclaimer, the term of this patent is extended or adjusted under 35 U.S.C. 154(b) by 852 days.

(21) Appl. No.: 16/561,247

(22) Filed: Sep. 5, 2019

(65) Prior Publication Data

US 2021/0071899 A1 Mar. 11, 2021

(51) Int. Cl.

| | |
|---|---|
| ***F24F 11/72*** | (2018.01) |
| ***F24F 3/044*** | (2006.01) |
| ***F24F 110/30*** | (2018.01) |

(52) U.S. Cl.

CPC ..... *F24F 11/72* (2018.01); *F24F 3/044* (2013.01); *F24F 2110/30* (2018.01)

(58) Field of Classification Search

CPC ..... F24F 11/72; F24F 3/044; F24F 2110/30
See application file for complete search history.

(56) References Cited

U.S. PATENT DOCUMENTS

| | | | | |
|---|---|---|---|---|
| 3,305,001 | A | 2/1967 | Haufler et al. | |
| 4,024,728 | A | 5/1977 | Gustafsson | |
| 4,034,801 | A | 7/1977 | Bernstein | |
| 4,495,986 | A | 1/1985 | Clark et al. | |
| 4,549,601 | A | 10/1985 | Wellman et al. | |
| 6,240,326 | B1 | 5/2001 | Gloudeman et al. | |
| 6,241,156 | B1 | 6/2001 | Kline et al. | |
| 6,250,560 | B1 | 6/2001 | Kline et al. | |
| 6,381,970 | B1 | 5/2002 | Eber et al. | |
| 6,487,457 | B1 | 11/2002 | Hull et al. | |
| 6,919,809 | B2 | 7/2005 | Blunn et al. | |
| 6,991,177 | B2 | 1/2006 | George | |
| 7,168,627 | B2 | 1/2007 | Kates | |
| 7,188,779 | B2 * | 3/2007 | Alles | F24F 3/0442 700/277 |
| 7,341,201 | B2 | 3/2008 | Stanimirovic | |
| 7,702,421 | B2 | 4/2010 | Sullivan et al. | |
| 7,963,454 | B2 | 6/2011 | Sullivan et al. | |
| 8,147,302 | B2 | 4/2012 | Desrochers et al. | |
| 8,180,493 | B1 * | 5/2012 | Laskow | F24F 11/30 165/203 |
| 8,196,185 | B2 | 6/2012 | Geadelmann et al. | |

(Continued)

*Primary Examiner* — Tavia Sullens
*Assistant Examiner* — Khaled Ahmed Ali Al Samiri
(74) *Attorney, Agent, or Firm* — Womble Bond Dickinson (US) LLP

(57) ABSTRACT

Architectures and techniques are presented that can more efficiently route excess air flow by intelligently selecting the zones to which the excess air flow is to be routed. Excess air flow results from an HVAC device providing (e.g., at a minimum setting) a volume of air that is greater than what is demanded by a zone that triggers activation of the HVAC device. As one example, excess air flow can be routed to a zone or zones that are determined to be most likely to trigger a subsequent activation condition that would cause the HVAC device to be activated again at a future time.

19 Claims, 9 Drawing Sheets

(56) References Cited

U.S. PATENT DOCUMENTS

| | | | | |
|---|---|---|---|---|
| 8,239,922 | B2 | 8/2012 | Sullivan et al. | |
| 8,695,888 | B2 | 4/2014 | Kates | |
| 8,755,943 | B2 | 6/2014 | Wenzel | |
| 8,793,022 | B2 | 7/2014 | Uden | |
| 8,830,267 | B2 | 9/2014 | Brackney | |
| 8,843,238 | B2 | 9/2014 | Wenzel et al. | |
| 9,134,715 | B2 | 9/2015 | Geadelmann et al. | |
| 9,152,153 | B2 | 10/2015 | Sullivan et al. | |
| 9,182,140 | B2 | 11/2015 | Kates | |
| 9,971,363 | B2 | 5/2018 | Leeland et al. | |
| 9,976,763 | B2 | 5/2018 | Leeland et al. | |
| 10,359,202 | B1 * | 7/2019 | Prather | F24F 11/72 |
| 2005/0284622 | A1 * | 12/2005 | Nichols | G05D 23/1934 165/205 |
| 2006/0091227 | A1 | 5/2006 | Attridge | |
| 2006/0234621 | A1 | 10/2006 | Desrochers et al. | |
| 2007/0023533 | A1 | 2/2007 | Liu | |
| 2008/0209342 | A1 | 8/2008 | Taylor et al. | |
| 2008/0222565 | A1 | 9/2008 | Taylor et al. | |
| 2008/0277486 | A1 | 11/2008 | Seem et al. | |
| 2008/0307803 | A1 | 12/2008 | Herzon | |
| 2009/0057424 | A1 | 3/2009 | Sullivan et al. | |
| 2010/0102135 | A1 * | 4/2010 | Alles | F24F 3/044 236/49.1 |
| 2010/0242509 | A1 | 9/2010 | Lifson et al. | |
| 2010/0286937 | A1 | 11/2010 | Hedley et al. | |
| 2010/0307733 | A1 | 12/2010 | Karamanos et al. | |
| 2011/0213502 | A1 | 9/2011 | Uden | |
| 2012/0031984 | A1 | 2/2012 | Feldmeier et al. | |
| 2012/0072030 | A1 | 3/2012 | Elliott | |
| 2014/0131009 | A1 | 5/2014 | Zhou et al. | |
| 2014/0249680 | A1 | 9/2014 | Wenzel | |
| 2014/0277765 | A1 | 9/2014 | Karimi et al. | |
| 2015/0204551 | A1 | 7/2015 | Nair et al. | |
| 2015/0247646 | A1 | 9/2015 | Song et al. | |
| 2015/0253027 | A1 | 9/2015 | Lu et al. | |
| 2016/0146522 | A1 | 5/2016 | Hung | |
| 2016/0210569 | A1 | 7/2016 | Enck | |
| 2016/0377305 | A1 * | 12/2016 | Kwa | F24F 11/30 700/277 |
| 2017/0023269 | A1 | 1/2017 | Gevelber | |
| 2017/0052536 | A1 | 2/2017 | Warner et al. | |
| 2017/0115021 | A1 * | 4/2017 | Ni | F24F 11/30 |
| 2017/0206615 | A1 * | 7/2017 | Sloop | F24F 11/30 |
| 2018/0238576 | A1 | 8/2018 | Leeland et al. | |
| 2018/0372363 | A1 * | 12/2018 | Park | F24F 11/63 |

* cited by examiner

EFFICIENTLY ROUTING EXCESS AIR FLOW

TECHNICAL FIELD

The present disclosure is directed to systems, apparatuses, and methods for determining which zone(s) are to receive excess air flow, and more particularly to determining the zones in a manner that is efficient.

BACKGROUND

Modern heating, ventilation, and air conditioning (HVAC) systems can provide conditioned air to a large group of individually controllable zones. Typically, the HVAC system is designed to be capable to meet the needs of the entire group. Hence, it is a common situation that one of the HVAC devices, such as an air handler or the like, when activated at a minimum setting, will provide more tempered air than is necessary to serve any one zone. It is also a common situation for a single zone from among the group to meet conditions such as a set point criterion that will cause the HVAC device to activate while the remainder of the zones do not meet any such conditions, and therefore do not need and/or do not trigger the HVAC device. As a result, the HVAC device is activated at a minimum setting (e.g., 750 cubic feet per minute (CFM)), that still provides more airflow than is needed to meet the demands of the signaling zone (e.g., 100 CFM). This remainder (e.g., 750 CFM−100 CFM=650 CFM), is referred to herein as excess air flow.

SUMMARY

The following presents a summary to provide a basic understanding of one or more embodiments of the disclosure. This summary is not intended to identify key or critical elements or delineate any scope of the particular embodiments or any scope of the claims. Its sole purpose is to present concepts in a simplified form as a prelude to the more detailed description that is presented later.

According to an embodiment of the present disclosure, a device can comprise a processor and a memory that stores executable instructions that, when executed by the processor, facilitate performance of operations. The computer executable instructions can comprise determining that a heating, ventilation, and air conditioning (HVAC) device, configured to provide a defined volume of air, is indicated to activate in response to an activation condition being satisfied with respect to a first zone of a group of zones. The computer executable instructions can comprise determining an excess volume of air representative of the defined volume of air provided by the HVAC device less a first zone volume that is delivered to the first zone. The computer executable instructions can comprise, performing an excess routing procedure that identifies a second zone of the group of zones to which to route at least a portion of the excess volume.

According to an embodiment of this disclosure, the performing the excess routing procedure can comprise determining that the second zone, from among the group of zones, is most likely to trigger a subsequent activation condition for the HVAC device.

According to an embodiment of this disclosure, the performing the excess routing procedure can comprise determining respective differences between respective measured quantities of respective zones of the group and corresponding unoccupied set points of the respective zones. Thereafter, the second zone can be identified in response to determining that the second zone has a smallest difference from among the respective differences.

According to an embodiment of this disclosure, the performing the excess routing procedure can comprise determining respective differences between respective measured quantities of respective zones of the group and corresponding occupied set points of the respective zones. Thereafter, the second zone can be identified in response to determining that the second zone has a largest difference from among the respective differences.

According to an embodiment of this disclosure, the performing the excess routing procedure can comprise determining respective rates of change of respective measured quantities of respective zones of the group. Thereafter, the second zone can be identified based on respective states of the respective zones and the respective rates of change.

According to an embodiment of this disclosure, the performing the excess routing procedure can comprise identifying the second zone based on a determination that the second zone is most likely, from among the group of zones, to be a next zone to be occupied.

In some embodiments, elements described in connection with the systems above can be embodied in different forms such as a computer-implemented method, a computer-readable medium, or another form.

DETAILED DESCRIPTION

Overview

Figure 1:
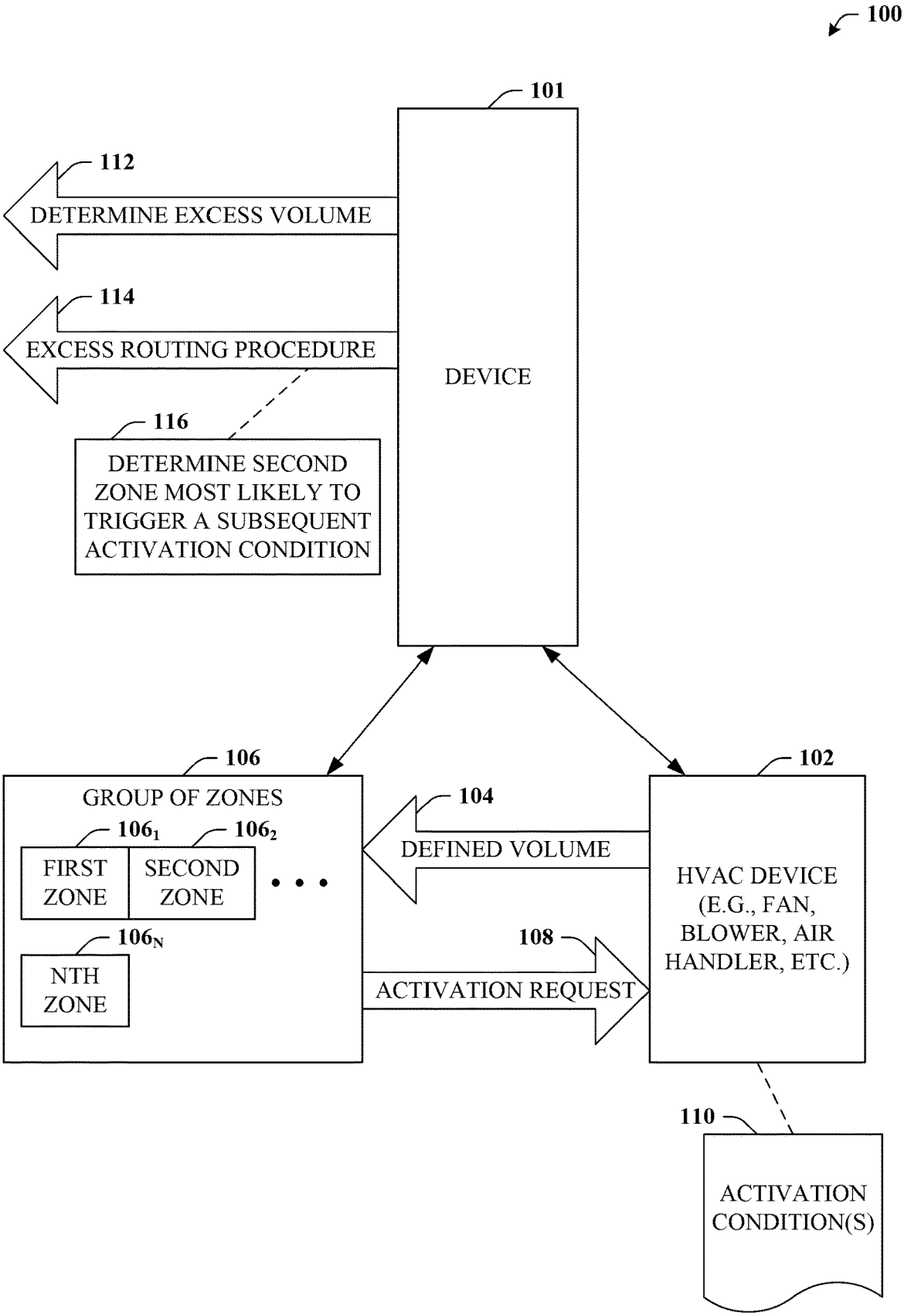
FIG. 1 illustrates a block diagram of an example non-limiting system that can provide more efficient routing of excess flow in accordance with one or more embodiments of the disclosed subject matter.

While this specification discusses and refers to an excess air flow, it is understood that the disclosed techniques can be applicable to any fluid flow in addition to air flow. As noted previously, a common situation arises where an HVAC device (e.g., a fan, blower, air handler, etc.) is activated in response to activation conditions being met by one or more zones served by the HVAC device. For example, if a given state of a zone satisfies an activation condition (e.g., a set point), such can trigger a signal to activate the HVAC device. Because the HVAC device can be sized to serve many zones, but only one zone or a few zones may be in a state to meet activation conditions, activating the HVAC device can be inefficient.

For instance, consider the case where the HVAC device provides, at a minimum setting, 750 CFM, whereas the zone that triggered the activation is supplied only 100 CFM. It is appreciated that if one or more zones collectively call for more than is provided by the minimum setting, say 800 CFM, the HVAC device might be activated at an intermediate setting that may provide, for example, 1000 CFM, causing an excess of 200 CFM. In either case, it is appreciated that excess air flow will exist, and the disclosed techniques are equally applicable to either scenario.

Returning to the first example, where the excess air flow is 650 CFM (e.g., 750 CFM provided by HVAC device less 100 CFM allocated to the activating zone), it can be especially inefficient or wasteful if that excess air flow is not put to work in some way in the system. Known approaches to allocating and/or routing the excess air flow are not satisfactory. For example, other systems that at least attempt to make use of the excess air flow tend take one of the two following approaches: (1) distribute the excess air flow among all zones or some predetermined subset of the zones; or (2) distribute the excess air flow to a predetermined specific class of zones. An example is common areas, such as bathrooms, conference rooms, or the like. Both approaches tend to be wasteful.

The disclosed subject matter introduces better intelligence in determining where to route excess air flow, which can be more efficient in terms of energy consumption. Furthermore, the disclosed techniques can reduce the duty cycle of HVAC equipment, which can extend the life of certain HVAC equipment. As one illustrative example, the disclosed subject matter can intelligently determine to route excess air flow to zones that are determined to be more likely to trigger a subsequent activation condition. Such can extend the time between the subsequent activation condition being triggered and/or reduce the load when the subsequent activation condition is triggered.

Example Systems

The disclosed subject matter is now described with reference to the drawings, wherein like reference numerals are used to refer to like elements throughout. In the following description, for purposes of explanation, numerous specific details are set forth in order to provide a thorough understanding of the disclosed subject matter. It may be evident, however, that the disclosed subject matter may be practiced without these specific details. In other instances, well-known structures and devices are shown in block diagram form in order to facilitate describing the disclosed subject matter.

Referring now to the drawings, with initial reference to FIG. 1, a block diagram of an example non-limiting system 100 is depicted that can provide more efficient routing of excess flow in accordance with one or more embodiments of the disclosed subject matter. In some embodiments, system 100 can comprise device 101 that can employed to make various determinations detailed herein. Device 100 can comprise a processor and a memory that stores executable instructions that, when executed by the processor, facilitate performance of operations. Examples of said processor and memory, as well as other suitable computer or computing-based elements, can be found with reference to FIG. 9, and can be used in connection with implementing one or more of the devices or components shown and described in connection with FIG. 1 or other figures disclosed herein. It should be understood that in the discussion of the present embodiment and of embodiments to follow, repetitive description of like elements employed in the various embodiments described herein is omitted for sake of brevity.

System 100 can further comprise a heating, ventilation, and air conditioning (HVAC) device 102, which can be for example, a fan, blower, air handler, and so forth. HVAC device 102 can be configured to provide a defined volume of air 104 (also referred to herein as defined volume 104 and airflow 104) upon activation. Defined volume 104 can be representative of a volume of air that is provided by HVAC device 102 based on a setting, typically, but not necessarily, a minimum setting for the HVAC device 102.

Defined volume 104 can be provided to some portion of group of zones 106, illustrated here as first zone $\mathbf{106}_1$ to Nth zone $\mathbf{106}_N$, where N can be any whole number, but will typically be greater than three. In some embodiments, individual members of group of zones 106 can be individually controlled. For example, distinct set points can be input for any member of the group of zones 106. When a state of one of the group of zones 106 (e.g., first zone $\mathbf{106}_1$) satisfies a set point (or other activation condition 110), an appropriate device can transmit activation request 108 to HVAC device 102, indicating that HVAC device 102 is to be activated.

Device 101 can determine that HVAC device 102 is indicated to be activated (e.g., receiving and potentially forwarding activation request 108). In response, device 101 can perform determination 112. Determination 112 can comprise determining an excess volume of air. The excess volume of air can represent defined volume 104 (e.g., provided by HVAC device 102 at a minimum or other setting) less a first zone volume that is to be delivered to the zone triggering activation request 108 (e.g., first zone $\mathbf{106}_1$).

Once the excess volume is determined, device 101 can perform excess routing procedure 114. Excess routing procedure 114 can identify a second zone $\mathbf{106}_2$ of the group of zones 106 to which to route at least a portion of the excess volume. Excess routing procedure can include determination 116. Determination 116 can comprise determining that second zone $\mathbf{106}_2$, from among group of zones 106, is most likely to trigger a subsequent activation condition for HVAC device 102.

In some embodiments, if multiple zones are determined to be equally likely to trigger the subsequent activation condition, second zone $\mathbf{106}_2$ can be selected due to the amount of CFM required. For example, of the two candidates, the zone that has a CFM requirement that is closest to using up the excess routing procedure without going under can be selected. In some embodiments, excess routing procedure 114 can be performed iteratively to identify additional zone(s) of group of zones 106 to which to route the excess volume until no excess volume remains.

Figure 2A:
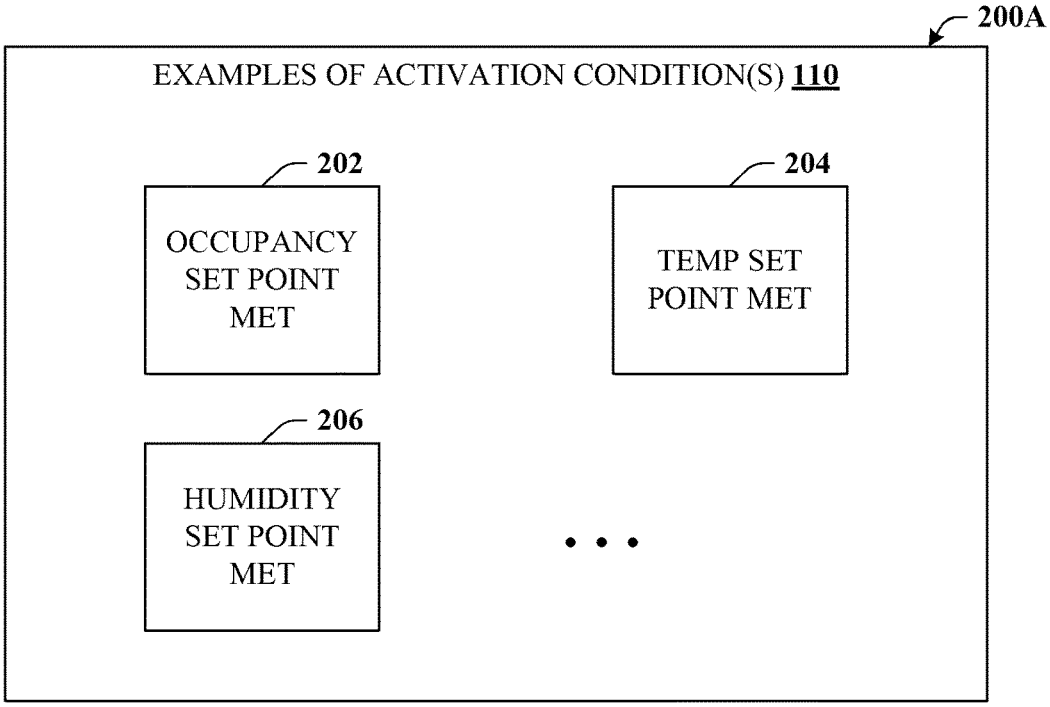
FIG. 2A illustrates a block diagram depicting non-limiting examples of one or more activation condition(s) in accordance with one or more embodiments of the disclosed subject matter.

While still referring to FIG. 1, but turning as well to FIG. 2A, a block diagram 200A is presented depicting non-limiting examples of activation condition(s) 110 in accordance with one or more embodiments of the disclosed subject matter. As noted, any zone of the group of zones 106 can potentially trigger HVAC device 102. In some embodiments, activation condition 110 can be the result of manual input or signal, while in other embodiments, activation condition 110 can be satisfied in response to a determination that a first measured quantity meets a first value designated by a set point. Examples 202-206 represent examples of an occupancy set point, a temperature set point, a humidity set point, etc. being met or satisfied.

It is appreciated that a given zone 106 can have multiple set points, for example, an occupied set point and an unoccupied set point. The unoccupied set point is typically not as comfortable to occupants as the occupied set point, but rather is selected to reduce the demands on the HVAC system. For instance, during the day when an associated building is occupied, group of zones 106 can operate according to comfort settings associated with occupied set points. At night, when few or no people are in the building, group of zones 106 can operate according to the unoccupied set points in which comfort settings and other thresholds can be greatly relaxed. If however, someone enters one of the zones 106, such can satisfy activation condition 110, either by satisfying occupancy set point 202 or satisfying temperature set point 204, humidity set point 206 or another suitable set point as the associated set point reverts from the unoccupied value to the occupied value.

Figure 2B:
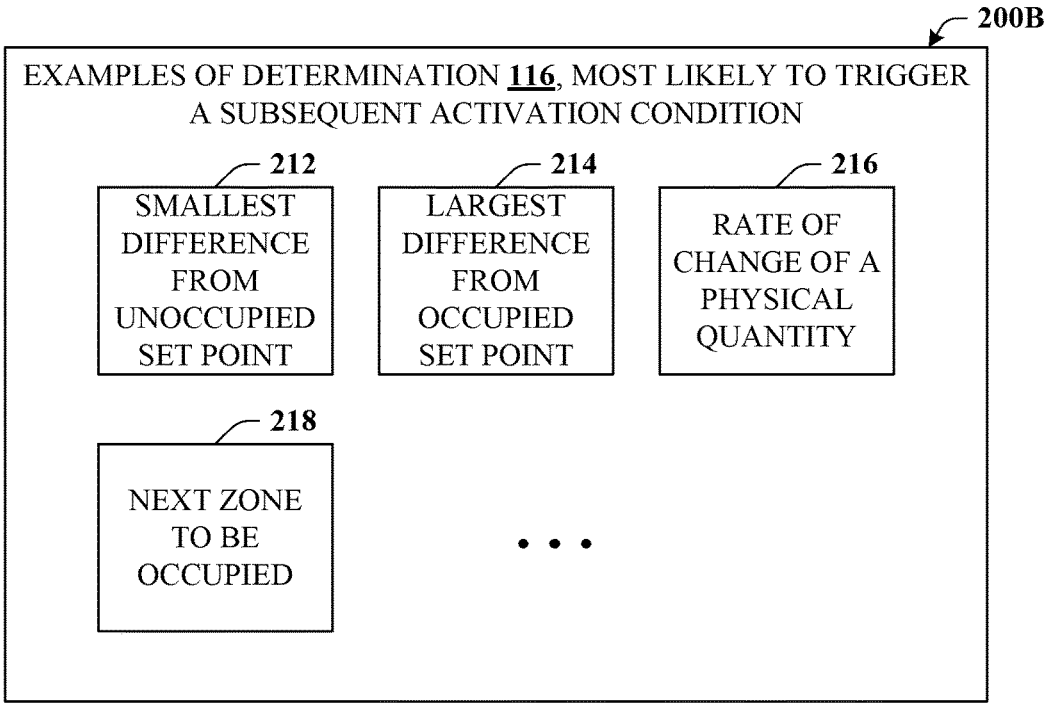
FIG. 2B illustrates a block diagram depicting non-limiting examples of a determination of a zone most likely to trigger a subsequent activation condition in accordance with one or more embodiments of the disclosed subject matter.

Regardless, once activation condition 110 is satisfied, a signal (e.g., activation request 108) can be sent to trigger activation of HVAC device 102 and device 101 can perform excess routing procedure 114 to determine where to route the excess flow. As mentioned, excess routing procedure 114 can comprise determination 116 that identifies a zone 106 that is most likely to trigger a subsequent activation condition FIG. 2B illustrates a block diagram 200B depicting non-limiting examples of determination 116 in accordance with one or more embodiments of the disclosed subject matter. In some embodiments, determination 116 can rely on knowledge of zone 106 state data and other information, which is described in more detail with reference to FIGS. 3 and 4. For example, determination 116 can depend on whether zones 106 are occupied or unoccupied as well as the respective set points for both and current physical conditions of the group of zones 106. The inventors have observed that in the case of an unoccupied building it can be more efficient to reduce the number of times HVAC device 102 cycles on.

Therefore, supposing first zone $\mathbf{106}_1$ triggers activation condition 110 because a temperature of first zone $\mathbf{106}_1$ meets an unoccupied set point, device 101 can examine how close other zones 106 are to meeting their own respective unoccupied set points. The zone 106, e.g., second zone $\mathbf{106}_2$, with the smallest difference from an associated unoccupied set point can be inferred to be the one most likely to trigger a subsequent activation condition, which is illustrated at reference numeral 212. Hence, second zone $\mathbf{106}_2$ that is nearest to the conditions that will trigger a subsequent activation condition can be selected to receive all or a portion of the excess air flow. In other words, device 101 can determine respective differences between respective measured quantities (e.g., occupancy, temperature, humidity, etc.) of respective zones 106 and corresponding unoccupied set points of the respective zones 106. Next, device 101 can identify second zone $\mathbf{106}_2$ in response to determining that second zone $\mathbf{106}_2$ has the smallest difference from among the respective differences. As a result, the physical state of second zone $\mathbf{106}_2$ will move away from the unoccupied set point, and thus be less likely to trigger a subsequent activation condition.

As another example illustrated by reference numeral 214, determination 116 can identify second zone $\mathbf{106}_2$ as most likely to trigger a subsequent activation condition based on having a largest difference from an occupied set point. It is understood that the physical conditions of the group of zones 106 will typically be in a range between the occupied set point (that is no longer enforced when unoccupied) and the unoccupied set point (that, if met, will trigger activation of HVAC device 102). Depending on settings, some zones 106 can be much farther away from the occupied set point than others, without nearing the unoccupied set point that would trigger HVAC device 102 activation. The inventors have observed that in the case of a very large difference from an occupied set point, when the second zone $\mathbf{106}_2$ does become occupied, it can take a long time to correct the temperature or other physical conditions of second zone $\mathbf{106}_2$, which can also be inefficient or less desirable.

In other words, device 101 can determine respective differences between respective measured quantities (e.g., occupancy, temperature, humidity, etc.) of respective zones 106 and corresponding occupied set points of the respective zones 106. Next, device 101 can identify second zone $\mathbf{106}_2$ in response to determining that second zone $\mathbf{106}_2$ has the largest difference from among the respective differences. As a result, the physical state of second zone $\mathbf{106}_2$ can be brought to the occupied set point thresholds more quickly.

In another example illustrated by reference numeral 216, determination 116 can identify second zone $\mathbf{106}_2$ as most likely to trigger a subsequent activation condition based on a rate of change of a physical quantity. In other words, device 101 can determine respective rates of change of respective measured quantities of respective zones 106. Next, device 101 can identify second zone $\mathbf{106}_2$ in response to determining that second zone $\mathbf{106}_2$ has the highest rate of change either away from an occupied set point or toward an unoccupied set point. It is understood that having a greater rate of change can be another indicator in determining zones 106 that are most likely to trigger a subsequent activation condition.

Reference numeral 218 illustrates yet another mechanism for determination 116. For example, based on a history, a schedule, or other data, second zone $\mathbf{106}_2$ can be identified as most likely to trigger a subsequent activation condition based on a determination that second zone $\mathbf{106}_2$ will be occupied next. As explained, when a zone 106 becomes occupied, set points can revert from the unoccupied setting to the occupied setting, which will typically trigger activation request 108. By providing second zone $\mathbf{106}_2$ with the excess flow in advance, the effects of switching to occupied mode can be reduced sharply.

Figure 3:
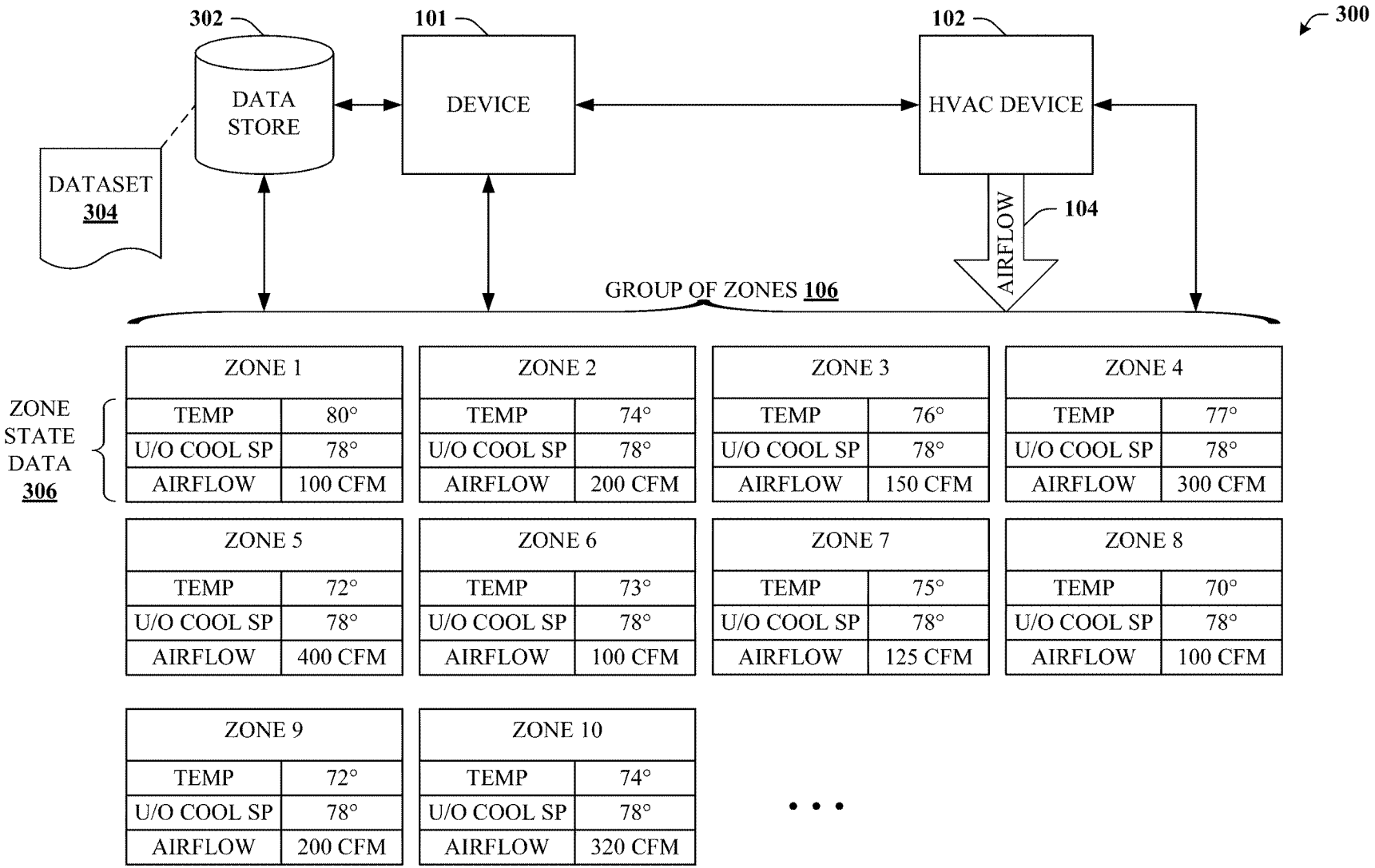
FIG. 3 illustrates a block diagram of an example non-limiting system that illustrates in more detail an example determinations in accordance with one or more embodiments of the disclosed subject matter.

With reference now to FIG. 3, a block diagram of an example non-limiting system 300 is depicted. System 300 illustrates in more detail an example of determination 116 in accordance with one or more embodiments of the disclosed subject matter. In this example, determination 116 of a zone 106 most likely to trigger a subsequent activation condition is made according to smallest difference from unoccupied set point 212 discussed in connection with FIG. 2B.

System 300 can include device 101 that can perform determination 116 as well as other determinations detailed herein, and HVAC device 102 that, when activated, can provide the defined volume 104 of air, illustrated here as airflow 104, which, in this example is 750 CFM. HVAC device 102 serves ten different zones, each of which can be individually controlled and thus maintain individual set points.

Device 101 can include or be communicatively coupled to data store 302 that can store various data sets 304 that can be employed to determine excess volume 112 or perform excess routing procedure 114. For example, data set 304 can include information about various settings for HVAC device and the defined volume 104. Data set 304 can further include various zone state data 306 indicative of a states (e.g., physical conditions) of the various zones, corresponding set point, both occupied and unoccupied, and so forth. The present example is directed to a non-limiting cooling example.

As depicted, zone 1 has a current temperature of 80° that is above the unoccupied cooling set point of 78°, which causes activation request 108. No other zones meet conditions that would trigger HVAC device 102 activation. Device 101 can determine that HVAC device 102 is being activated and further determine the excess volume. In this case, the defined volume 104 is 750 CFM (e.g., a minimum setting for HVAC device 102) while the airflow demand of zone 1 is 100 CFM. Thus, the excess volume is 750-100=650 CFM, which device 101 can intelligently allocate based on performing the excess routing procedure 114.

Excess routing procedure 114, in this example, can identify a current deviation or difference from the corresponding unoccupied set point. In order of smallest to largest zone 4 is only 1° away from the unoccupied set point and therefore can be considered to be most likely to trigger a subsequent activation condition that will activate HVAC device 102. Next is zone 3, which is 2° away from the respective unoccupied set point, followed by zone 7 (3° away), zones 1 and 10 (4° away), zone 6 (5° away) zones 5 and 9 (6° away), and zone 8 (8° away).

Once sorted on closest to set point, the zones can be chosen to meet defined volume 104. In this case, the excess routing procedure 114 selects zones 4, 3, 7, and 2. Including the 100 CFM demanded by zone 1, which triggered HVAC device 102, the total airflow demand of the selected zones is 100+300+150+125+200=875 CFM. It is noted that both zone 2 and zone 10 are 4° from their respective set points, however, the excess routing procedure 114 selected zone 2 instead of zone 10 because zone 2 provides the closest airflow match to the defined volume 104 provided by HVAC device 102 at the current setting. In other words, when multiple zones will meet the smallest different criteria, excess routing procedure 114 can first select the zones closest to their unoccupied set point. If multiple spaces have the same deviation from that set point (e.g., zones 2 and 10) the application can select the zone resulting in the closest total to defined volume 104 without going under. Had zone 10 been selected instead of zone 2, the total airflow demand would be 100+300+150+125+320=995 CFM, which is farther away from the defined volume of 750 CFM and thus less preferred in this embodiment. It is appreciated that, in other embodiments, the 995 CFM might be preferred and in those cases, zone 10 can be selected instead of zone 2.

Figure 4:
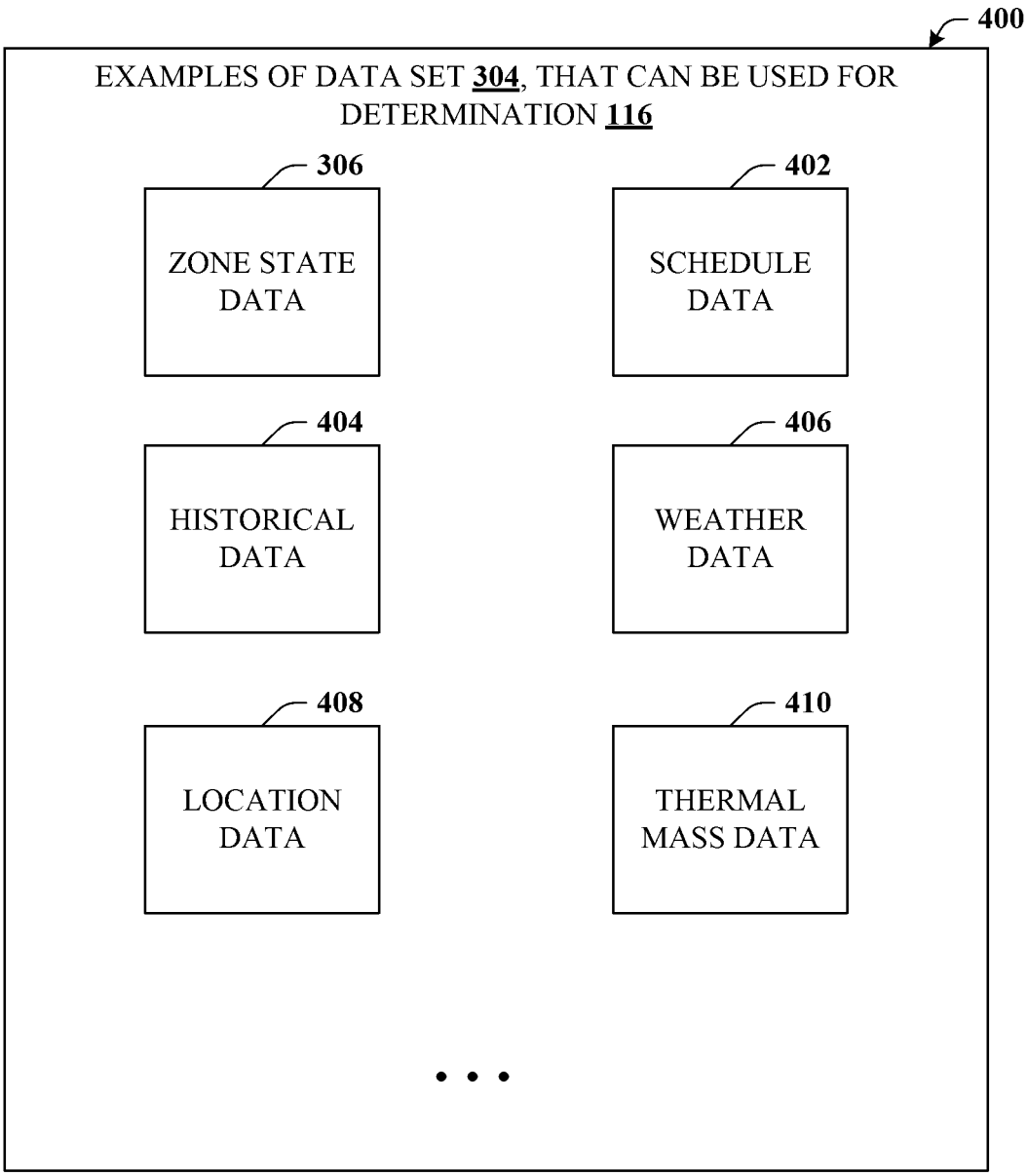
FIG. 4 illustrates a block diagram depicting non-limiting examples of a data set or other information that can be used in connection with various determinations detailed herein in accordance with one or more embodiments of the disclosed subject matter

Turning now to FIG. 4, a block diagram 400 is presented depicting non-limiting examples of data set 304 or other information that can be used in connection with determination 116 or other determinations detailed herein in accordance with one or more embodiments of the disclosed subject matter. For example, as noted, data set 304 can include zone state data 306 indicative of current, historical, or predicted states of group of zones 106. As another example, data set 304 can include schedule data 402 that can be indicative of expected changes to states of group of zones 106 or to a state of HVAC device 102 or another HVAC device.

In some embodiments, data set 304 can include historical data 404 that can be indicative of past changes to states of group of zones 106 or changes to a state of HVAC device 102 or another HVAC device. In some embodiments, data set 304 can include weather data 406 that can be indicative of past or expected changes to states of group of zones 106 or changes to a state of HVAC device 102 or another HVAC device. In some embodiments, data set 304 can include location data 408 that can be indicative of a physical location of group of zones 106, such as, for example, whether a zone is interior to the building or has exterior exposure, a salient direction of the exterior exposure (e.g., facing north, east, south, west, etc.) and so forth. In some embodiments, data set 304 can include thermal mass data 410 that can be indicative of a time or an energy metric to change the states of group of zones 106.

Figure 5:
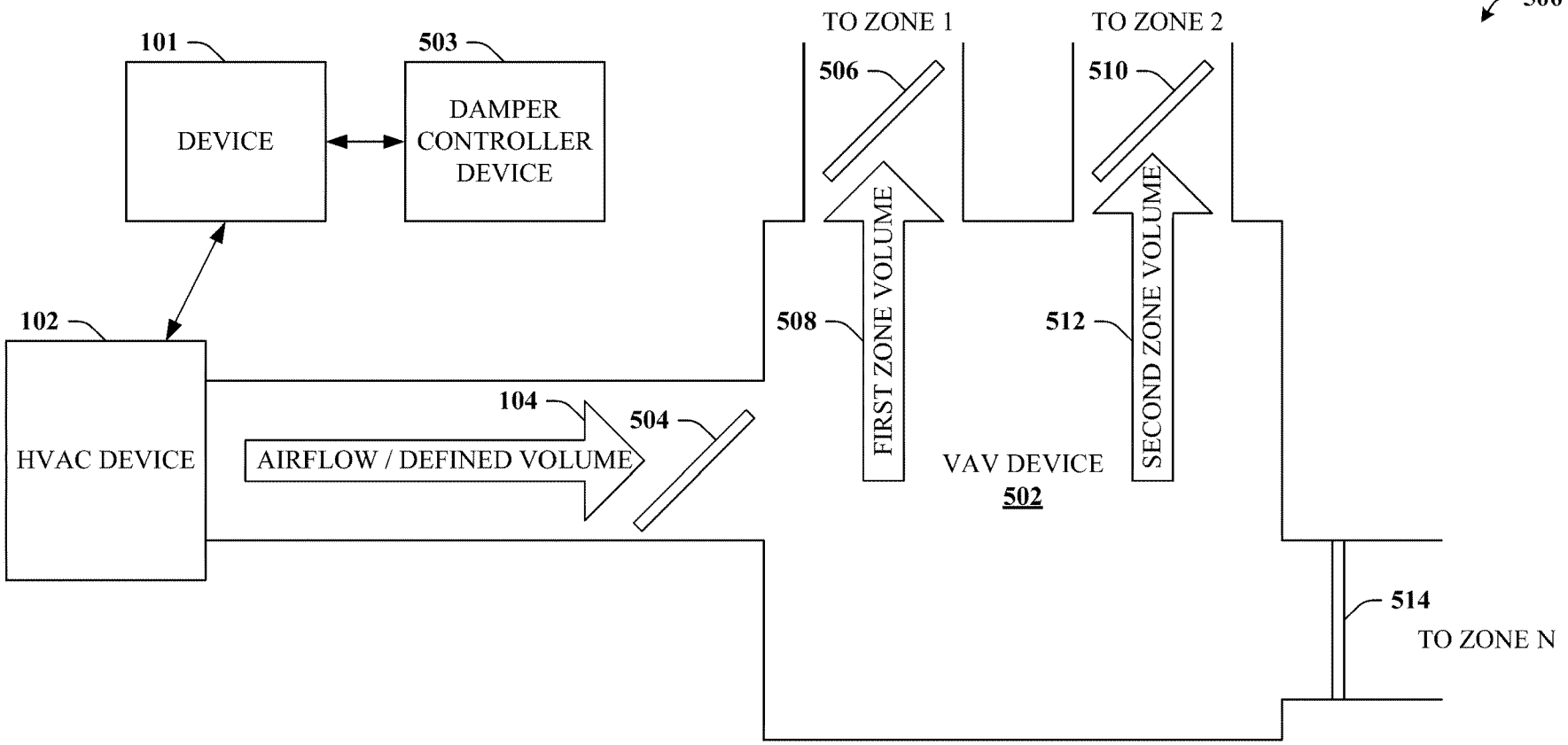
FIG. 5 illustrates a block diagram of system depicting non-limiting examples of controlling dampers to effectuate the routing of excess volume in accordance with one or more embodiments of the disclosed subject matter.

Referring now to FIG. 5, a block diagram of system 500 is presented depicting non-limiting examples of controlling dampers to effectuate the routing of excess volume in accordance with one or more embodiments of the disclosed subject matter. Device 101 can include or be coupled to damper controller device 503 that can control, e.g., via an actuator or motor, various dampers of a variable air volume (VAV) device 502, including inlet damper 504 and one or more outlet dampers 506, 510, and 514. In this example, it is again assumed that zone 1 triggers activation of HVAC device 102, causing defined volume 104 to be provided. In response, inlet damper 504 and outlet damper 506 can be opened, at least partially, and the airflow demand of zone 1 provided, illustrated here as first zone volume 508. Device 101 can perform excess routing procedure 114 to determine that the excess volume should be routed to zone 2 and possible other zones (not shown). Hence, outlet damper 510 can be at least partially opened to allow second zone volume 512 to reach zone 2. Zone not selected by excess routing procedure 114, such as zone N, can have associated dampers (e.g., outlet damper 514) closed.

Figure 6A:
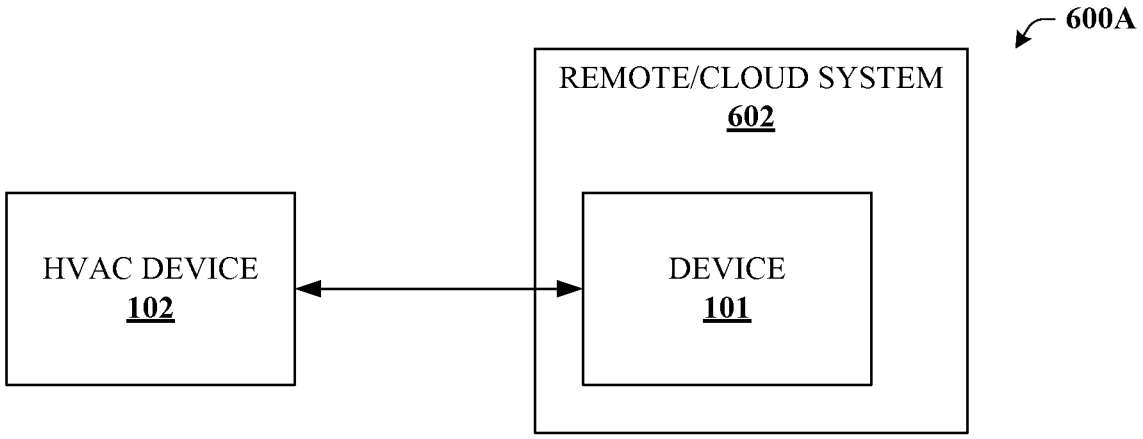
FIGS. 6A-C illustrate block diagrams of example architectural implementations that can be employed in accordance with one or more embodiments of the disclosed subject matter.
Figure 6B:
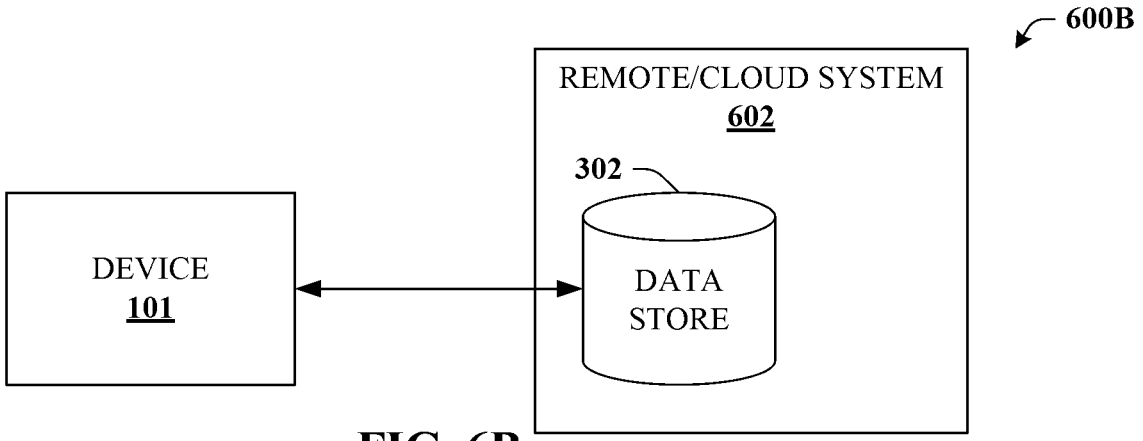
Figure 6C:
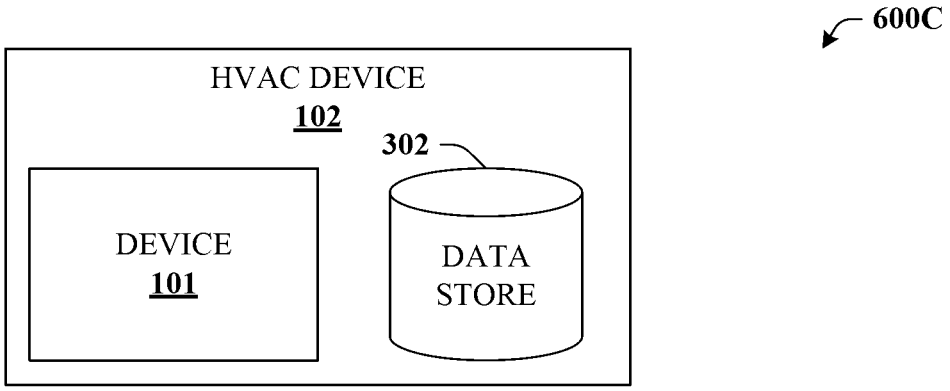

Turning now to FIGS. 6A-6C, various block diagrams 600A-600C of example architectural implementations are illustrated in accordance with one or more embodiments of the disclosed subject matter.

For example, block diagram 600A depicts an example architectural design in which device 101 is situated in a remote system such as a cloud system 602. Device 101 can be representative of a device that performs excess volume determination 112, excess routing procedure 114 as illustrated in connection with FIG. 1. In other words, in some embodiments, device 101 can be remote from HVAC device 102 and/or group of zones 106.

Block diagram 600B depicts an example architectural design in which data store 302 is in a remote system such as a cloud system 602. In this embodiment, device 101 can be situated at a user site and communicate with the cloud to make various determinations. In other embodiments, both device 101 and data store 302 can be situated in cloud system 602 and communicate with HVAC device 102 and/or group of zones 106 and associated devices.

Block diagram 600C depicts an example architectural design in which one or both user device 101 and data store 302 are components of HVAC device 102, which can be situated at the user site.

Example Methods

Figure 7:
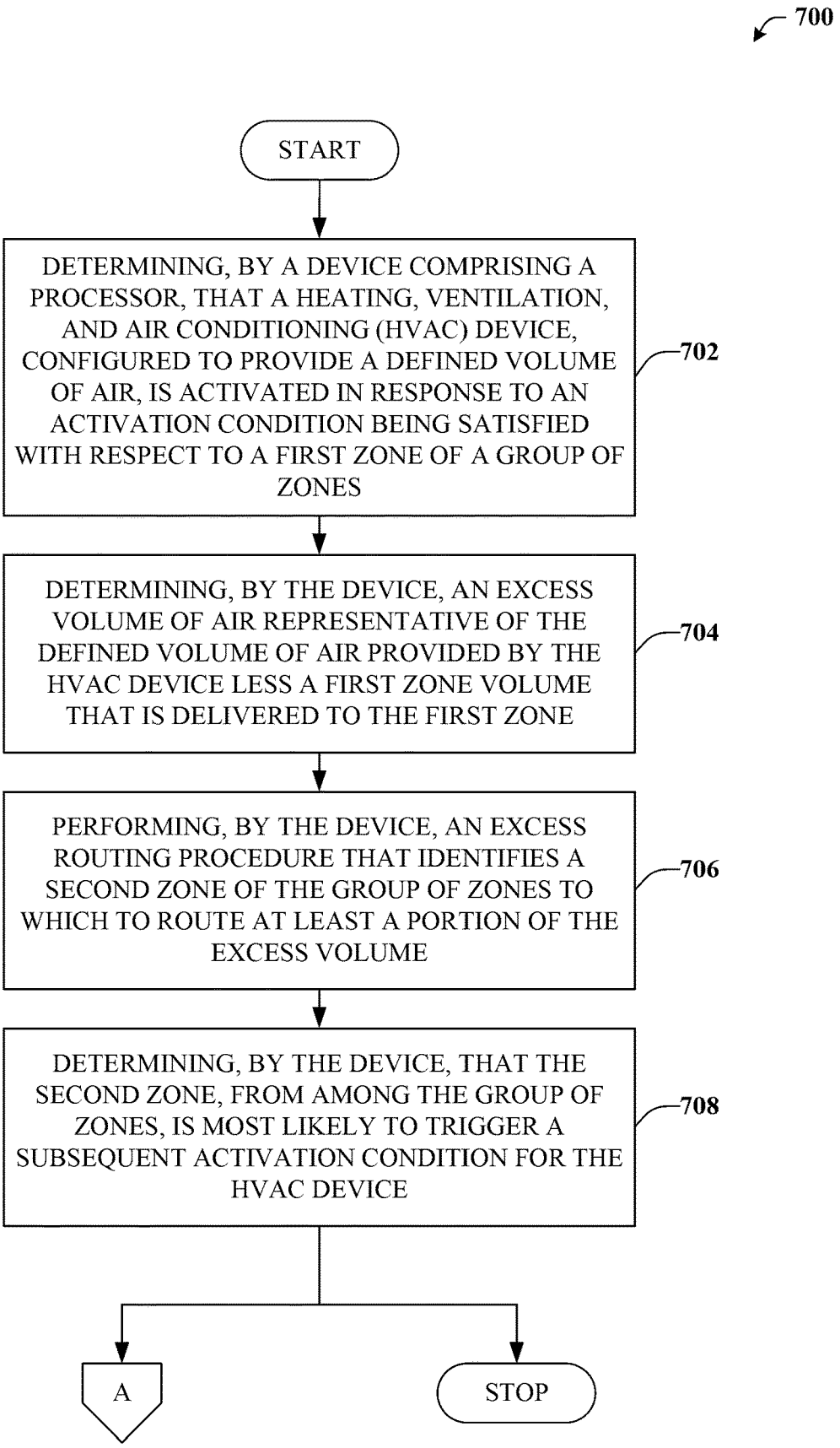
FIG. 7 illustrates a flow diagram of an example, non-limiting computer-implemented method that can efficiently route excess airflow in accordance with one or more embodiments of the disclosed subject matter.
Figure 8:
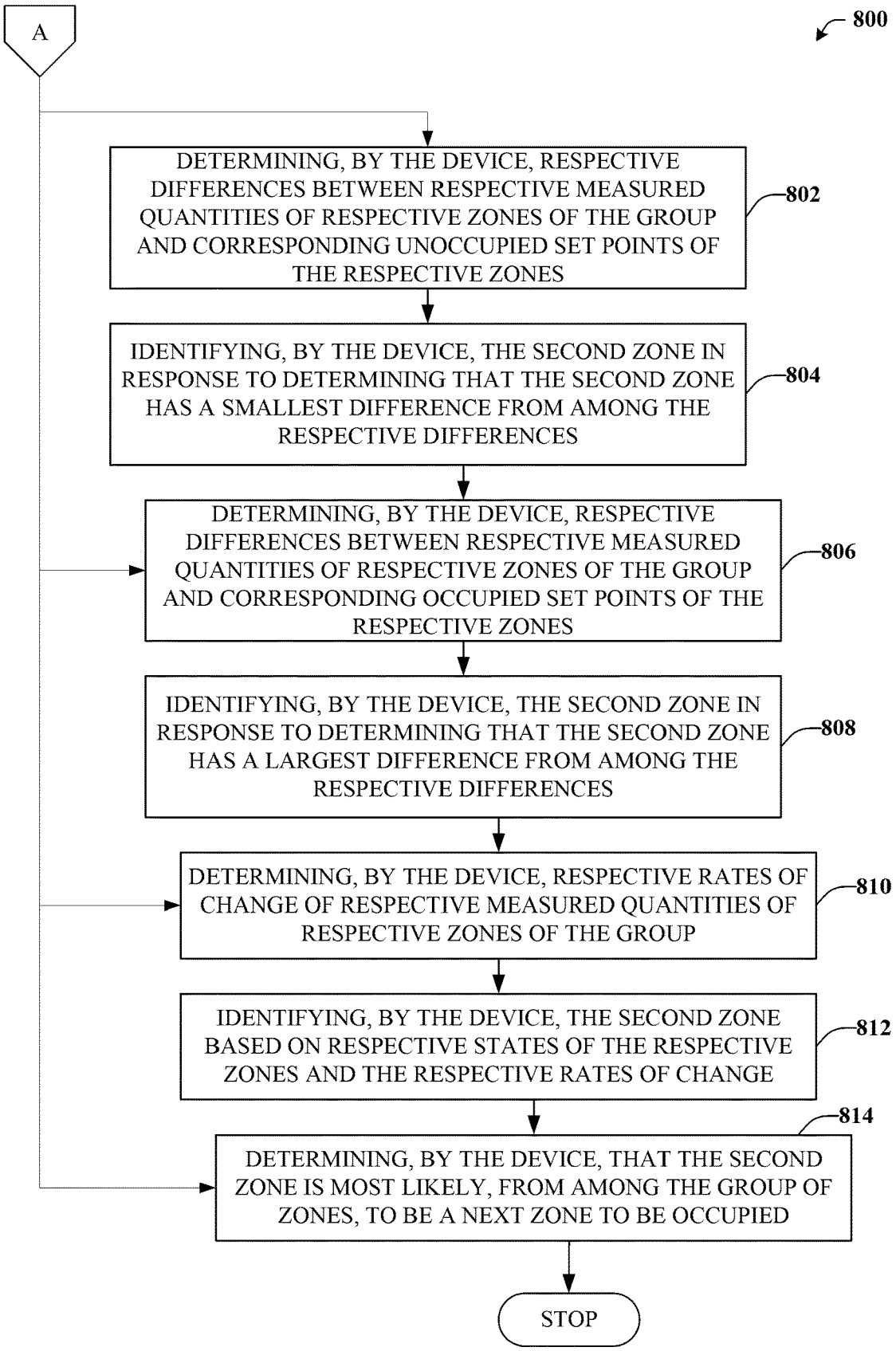
FIG. 8 illustrates a flow diagram of an example, non-limiting computer-implemented method providing additional aspects or elements in connection with efficiently routing excess airflow in accordance with one or more embodiments of the disclosed subject matter.

FIGS. 7 and 8 illustrate various methodologies in accordance with the disclosed subject matter. While, for purposes of simplicity of explanation, the methodologies are shown and described as a series of acts, it is to be understood and appreciated that the disclosed subject matter is not limited by the order of acts, as some acts can occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts can be required to implement a methodology in accordance with the disclosed subject matter. Additionally, it should be further appreciated that the methodologies disclosed hereinafter and throughout this specification are capable of being stored on an article of manufacture to facilitate transporting and transferring such methodologies to computers.

FIG. 7 illustrates a flow diagram 700 of an example, non-limiting computer-implemented method that can efficiently route excess airflow in accordance with one or more embodiments of the disclosed subject matter. For example, at reference numeral 702, a device (e.g., device 101) comprising a processor can determine that a heating, ventilation, and air conditioning (HVAC) device, configured to provide a defined volume of air, is activated in response to an activation condition being satisfied with respect to a first zone of a group of zones.

At reference numeral 704, the device can determine an excess volume of air representative of the defined volume of air provided by the HVAC device less a first zone volume that is delivered to the first zone.

At reference numeral 706, the device can perform an excess routing procedure that identifies a second zone of the group of zones to which to route at least a portion of the excess volume. At reference numeral 708, as part of the excess routing procedure, the device can determine that the second zone, from among the group of zones, is most likely to trigger a subsequent activation condition for the HVAC device. Method 700 can proceed to insert A, which is further detailed in connection with FIG. 8, or terminate.

Turning now to FIG. 8, illustrated is a flow diagram 800 of an example, non-limiting computer-implemented method that can provide additional aspects or elements in connection with efficiently routing excess airflow in accordance with one or more embodiments of the disclosed subject matter. For example, FIG. 8 depicts various embodiments of the excess routing procedure and/or various distinct ways to select the zone or zones to which to route the excess volume.

At reference numeral 802, the device can determine respective differences between respective measured quantities of respective zones of the group and corresponding unoccupied set points of the respective zones. At reference numeral 804, the device can identify the second zone in response to determining that the second zone has a smallest difference from among the respective differences.

Additionally or alternatively, at reference numeral 806, the device can determine respective differences between respective measured quantities of respective zones of the group and corresponding occupied (as opposed to unoccupied) set points of the respective zones. At reference numeral 808, the device can identify the second zone in response to determining that the second zone has a largest difference from among the respective differences.

Additionally or alternatively, at reference numeral 810, the device can determine respective rates of change of respective measured quantities of respective zones of the group. At reference numeral 812, the device can identify the second zone based on respective states of the respective zones and the respective rates of change. For instance, based on both how near to the set point corresponding physical conditions or other states are and how high the rate of change is.

Additionally or alternatively, at reference numeral 814, the device can determine that the second zone is most likely to trigger the subsequent activation condition based on a determination, by the device, that the second zone is most likely, from among the group of zones, to be a next zone to be occupied.

Example Operating Environments

Figure 9:
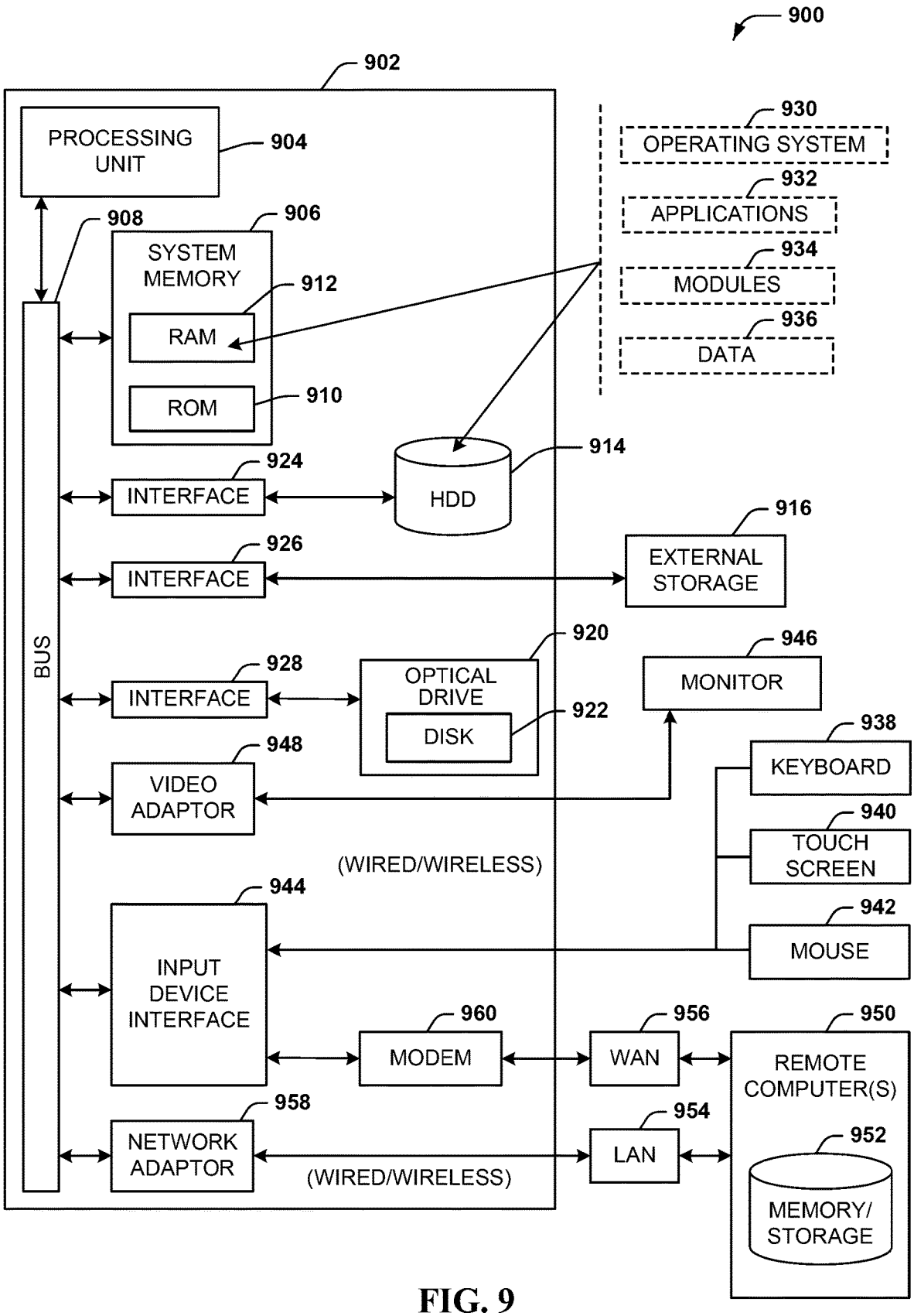
FIG. 9 illustrates a block diagram of an example, non-limiting operating environment in which one or more embodiments described herein can be facilitated.

In order to provide additional context for various embodiments described herein, FIG. 9 and the following discussion are intended to provide a brief, general description of a suitable computing environment 900 in which the various embodiments of the embodiment described herein can be implemented. While the embodiments have been described above in the general context of computer-executable instructions that can run on one or more computers, those skilled in the art will recognize that the embodiments can be also implemented in combination with other program modules and/or as a combination of hardware and software.

Generally, program modules include routines, programs, components, data structures, etc., that perform particular tasks or implement particular abstract data types. Moreover, those skilled in the art will appreciate that the inventive methods can be practiced with other computer system configurations, including single-processor or multiprocessor computer systems, minicomputers, mainframe computers, Internet of Things (IoT) devices, distributed computing systems, as well as personal computers, hand-held computing devices, microprocessor-based or programmable consumer electronics, and the like, each of which can be operatively coupled to one or more associated devices.

The illustrated embodiments of the embodiments herein can be also practiced in distributed computing environments where certain tasks are performed by remote processing devices that are linked through a communications network. In a distributed computing environment, program modules can be located in both local and remote memory storage devices.

Computing devices typically include a variety of media, which can include computer-readable storage media, machine-readable storage media, and/or communications media, which two terms are used herein differently from one another as follows. Computer-readable storage media or machine-readable storage media can be any available storage media that can be accessed by the computer and includes both volatile and nonvolatile media, removable and non-removable media. By way of example, and not limitation, computer-readable storage media or machine-readable storage media can be implemented in connection with any method or technology for storage of information such as computer-readable or machine-readable instructions, program modules, structured data or unstructured data.

Computer-readable storage media can include, but are not limited to, random access memory (RAM), read only memory (ROM), electrically erasable programmable read only memory (EEPROM), flash memory or other memory technology, compact disk read only memory (CD-ROM), digital versatile disk (DVD), Blu-ray disc (BD) or other optical disk storage, magnetic cassettes, magnetic tape, magnetic disk storage or other magnetic storage devices, solid state drives or other solid state storage devices, or other tangible and/or non-transitory media which can be used to store desired information. In this regard, the terms "tangible" or "non-transitory" herein as applied to storage, memory or computer-readable media, are to be understood to exclude only propagating transitory signals per se as modifiers and do not relinquish rights to all standard storage, memory or computer-readable media that are not only propagating transitory signals per se.

Computer-readable storage media can be accessed by one or more local or remote computing devices, e.g., via access requests, queries or other data retrieval protocols, for a variety of operations with respect to the information stored by the medium.

Communications media typically embody computer-readable instructions, data structures, program modules or other structured or unstructured data in a data signal such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

With reference again to FIG. 9, the example environment 900 for implementing various embodiments of the aspects described herein includes a computer 902, the computer 902 including a processing unit 904, a system memory 906 and a system bus 908. The system bus 908 couples system components including, but not limited to, the system memory 906 to the processing unit 904. The processing unit 904 can be any of various commercially available processors. Dual microprocessors and other multi-processor architectures can also be employed as the processing unit 904.

The system bus 908 can be any of several types of bus structure that can further interconnect to a memory bus (with or without a memory controller), a peripheral bus, and a local bus using any of a variety of commercially available bus architectures. The system memory 906 includes ROM 910 and RAM 912. A basic input/output system (BIOS) can be stored in a non-volatile memory such as ROM, erasable programmable read only memory (EPROM), EEPROM, which BIOS contains the basic routines that help to transfer information between elements within the computer 902, such as during startup. The RAM 912 can also include a high-speed RAM such as static RAM for caching data.

The computer 902 further includes an internal hard disk drive (HDD) 914 (e.g., EIDE, SATA), one or more external storage devices 916 (e.g., a magnetic floppy disk drive (FDD) 916, a memory stick or flash drive reader, a memory card reader, etc.) and an optical disk drive 920 (e.g., which can read or write from a CD-ROM disc, a DVD, a BD, etc.). While the internal HDD 914 is illustrated as located within the computer 902, the internal HDD 914 can also be configured for external use in a suitable chassis (not shown). Additionally, while not shown in environment 900, a solid state drive (SSD) could be used in addition to, or in place of, an HDD 914. The HDD 914, external storage device(s) 916 and optical disk drive 920 can be connected to the system bus 908 by an HDD interface 924, an external storage interface 926 and an optical drive interface 928, respectively. The interface 924 for external drive implementations can include at least one or both of Universal Serial Bus (USB) and Institute of Electrical and Electronics Engineers (IEEE) 994 interface technologies. Other external drive connection technologies are within contemplation of the embodiments described herein.

The drives and their associated computer-readable storage media provide nonvolatile storage of data, data structures, computer-executable instructions, and so forth. For the computer 902, the drives and storage media accommodate the storage of any data in a suitable digital format. Although the description of computer-readable storage media above refers to respective types of storage devices, it should be appreciated by those skilled in the art that other types of storage media which are readable by a computer, whether presently existing or developed in the future, could also be used in the example operating environment, and further, that any such storage media can contain computer-executable instructions for performing the methods described herein.

A number of program modules can be stored in the drives and RAM 912, including an operating system 930, one or more application programs 932, other program modules 934 and program data 936. All or portions of the operating system, applications, modules, and/or data can also be cached in the RAM 912. The systems and methods described herein can be implemented utilizing various commercially available operating systems or combinations of operating systems.

Computer 902 can optionally comprise emulation technologies. For example, a hypervisor (not shown) or other intermediary can emulate a hardware environment for operating system 930, and the emulated hardware can optionally be different from the hardware illustrated in FIG. 9. In such an embodiment, operating system 930 can comprise one virtual machine (VM) of multiple VMs hosted at computer 902. Furthermore, operating system 930 can provide runtime environments, such as the Java runtime environment or the .NET framework, for applications 932. Runtime environments are consistent execution environments that allow applications 932 to run on any operating system that includes the runtime environment. Similarly, operating system 930 can support containers, and applications 932 can be in the form of containers, which are lightweight, standalone, executable packages of software that include, e.g., code, runtime, system tools, system libraries and settings for an application.

Further, computer 902 can be enabled with a security module, such as a trusted processing module (TPM). For instance with a TPM, boot components hash next in time boot components, and wait for a match of results to secured values, before loading a next boot component. This process can take place at any layer in the code execution stack of computer 902, e.g., applied at the application execution level or at the operating system (OS) kernel level, thereby enabling security at any level of code execution.

A user can enter commands and information into the computer 902 through one or more wired/wireless input devices, e.g., a keyboard 938, a touch screen 940, and a pointing device, such as a mouse 942. Other input devices (not shown) can include a microphone, an infrared (IR) remote control, a radio frequency (RF) remote control, or other remote control, a joystick, a virtual reality controller and/or virtual reality headset, a game pad, a stylus pen, an image input device, e.g., camera(s), a gesture sensor input device, a vision movement sensor input device, an emotion or facial detection device, a biometric input device, e.g., fingerprint or iris scanner, or the like. These and other input devices are often connected to the processing unit 904 through an input device interface 944 that can be coupled to the system bus 908, but can be connected by other interfaces, such as a parallel port, an IEEE 1394 serial port, a game port, a USB port, an IR interface, a BLUETOOTH® interface, etc.

A monitor 946 or other type of display device can be also connected to the system bus 908 via an interface, such as a video adapter 948. In addition to the monitor 946, a computer typically includes other peripheral output devices (not shown), such as speakers, printers, etc.

The computer 902 can operate in a networked environment using logical connections via wired and/or wireless communications to one or more remote computers, such as a remote computer(s) 950. The remote computer(s) 950 can be a workstation, a server computer, a router, a personal computer, portable computer, microprocessor-based entertainment appliance, a peer device or other common network node, and typically includes many or all of the elements described relative to the computer 902, although, for purposes of brevity, only a memory/storage device 952 is illustrated. The logical connections depicted include wired/wireless connectivity to a local area network (LAN) 954 and/or larger networks, e.g., a wide area network (WAN) 956. Such LAN and WAN networking environments are commonplace in offices and companies, and facilitate enterprise-wide computer networks, such as intranets, all of which can connect to a global communications network, e.g., the Internet.

When used in a LAN networking environment, the computer 902 can be connected to the local network 954 through a wired and/or wireless communication network interface or adapter 958. The adapter 958 can facilitate wired or wireless communication to the LAN 954, which can also include a wireless access point (AP) disposed thereon for communicating with the adapter 958 in a wireless mode.

When used in a WAN networking environment, the computer 902 can include a modem 960 or can be connected to a communications server on the WAN 956 via other means for establishing communications over the WAN 956, such as by way of the Internet. The modem 960, which can be internal or external and a wired or wireless device, can be connected to the system bus 908 via the input device interface 944. In a networked environment, program modules depicted relative to the computer 902 or portions thereof, can be stored in the remote memory/storage device 952. It will be appreciated that the network connections shown are example and other means of establishing a communications link between the computers can be used.

When used in either a LAN or WAN networking environment, the computer 902 can access cloud storage systems or other network-based storage systems in addition to, or in place of, external storage devices 916 as described above. Generally, a connection between the computer 902 and a cloud storage system can be established over a LAN 954 or WAN 956 e.g., by the adapter 958 or modem 960, respectively. Upon connecting the computer 902 to an associated cloud storage system, the external storage interface 926 can, with the aid of the adapter 958 and/or modem 960, manage storage provided by the cloud storage system as it would other types of external storage. For instance, the external storage interface 926 can be configured to provide access to cloud storage sources as if those sources were physically connected to the computer 902.

The computer 902 can be operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, store shelf, etc.), and telephone. This can include Wireless Fidelity (Wi-Fi) and Bluetooth® wireless technologies. Thus, the communication can be a predefined structure as with a conventional network or simply an ad hoc communication between at least two devices.

As used in this application, the terms "component," "system," "platform," "interface," and the like, can refer to and/or can include a computer-related entity or an entity related to an operational machine with one or more specific functionalities. The entities disclosed herein can be either hardware, a combination of hardware and software, software, or software in execution. For example, a component can be, but is not limited to being, a process running on a processor, a processor, an object, an executable, a thread of execution, a program, and/or a computer. By way of illustration, both an application running on a server and the server can be a component. One or more components can reside within a process and/or thread of execution and a component can be localized on one computer and/or distributed between two or more computers. In another example, respective components can execute from various computer readable media having various data structures stored thereon. The components can communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software or firmware application executed by a processor. In such a case, the processor can be internal or external to the apparatus and can execute at least a part of the software or firmware application. As yet another example, a component can be an apparatus that provides specific functionality through electronic components without mechanical parts, wherein the electronic components can include a processor or other means to execute software or firmware that confers at least in part the functionality of the electronic components. In an aspect, a component can emulate an electronic component via a virtual machine, e.g., within a cloud computing system.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. As used herein, the terms "example" and/or "exemplary" are utilized to mean serving as an example, instance, or illustration and are intended to be non-limiting. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is it meant to preclude equivalent exemplary structures and techniques known to those of ordinary skill in the art.

As it is employed in the subject specification, the term "processor" can refer to substantially any computing processing unit or device comprising, but not limited to, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein.

Further, processors can exploit nano-scale architectures such as, but not limited to, molecular and quantum-dot based transistors, switches and gates, in order to optimize space usage or enhance performance of user equipment. A processor can also be implemented as a combination of computing processing units. In this disclosure, terms such as "store," "storage," "data store," data storage," "database," and substantially any other information storage component relevant to operation and functionality of a component are utilized to refer to "memory components," entities embodied in a "memory," or components comprising a memory. It is to be appreciated that memory and/or memory components described herein can be either volatile memory or nonvolatile memory or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), flash memory, or nonvolatile random-access memory (RAM) (e.g., ferroelectric RAM (FeRAM). Volatile memory can include RAM, which can act as external cache memory, for example. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), direct Rambus RAM (DRRAM), direct Rambus dynamic RAM (DRDRAM), and Rambus dynamic RAM (RDRAM). Additionally, the disclosed memory components of systems or computer-implemented methods herein are intended to include, without being limited to including, these and any other suitable types of memory.

What has been described above include mere examples of systems and computer-implemented methods. It is, of course, not possible to describe every conceivable combination of components or computer-implemented methods for purposes of describing this disclosure, but one of ordinary skill in the art can recognize that many further combinations and permutations of this disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim. The descriptions of the various embodiments have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A device, comprising:

a processor; and a memory that stores executable instructions that, when executed by the processor, perform operations comprising:

determining that a heating, ventilation, and air conditioning (HVAC) device is to be activated to provide a defined volume of conditioned air to at least one active zone of a group of zones, the at least one active zone having satisfied an activation condition to activate the HVAC device, the group of zones also including a plurality of inactive zones that have not satisfied corresponding activation conditions to activate the HVAC device, determining that the HVAC device is to produce an excess volume of conditioned air, wherein the excess volume of conditioned air is representative of the defined volume of conditioned air less a volume that is to be delivered to the at least one active zone, performing an excess routing procedure to identify one or more of the plurality of inactive zones to receive a distribution of the excess volume of conditioned air, wherein the excess routing procedure includes:

(a) determining that an unoccupied zone of the plurality of inactive zones has a largest difference between a measured quantity and an occupied set point for the unoccupied zone, and (b) selecting the unoccupied zone based at least in part on (a) to receive at least a portion of the excess volume of conditioned air.

2. The device of claim 1, wherein the excess routing procedure further includes:

(c) determining that a second unoccupied zone of the plurality of inactive zones has a smallest difference between the measured quantity and an unoccupied set point for the second unoccupied zone; and (d) selecting the second unoccupied zone to receive at least a portion of the excess volume of conditioned air based at least in part on (c).

3. The device of claim 1, wherein the excess routing procedure further includes:

(e) determining that a second zone of the plurality of inactive zones has a largest rate of change of the measured quantity; and (f) selecting the second zone to receive at least a portion of the excess volume of conditioned air based at least in part on (e).

4. The device of claim 1, wherein the excess routing procedure further includes:

(g) determining that a second unoccupied zone of the plurality of inactive zones is most likely to change a state from unoccupied to occupied based at least in part on schedule data or historical data; and (h) selecting the second unoccupied zone to receive at least a portion of the excess volume of conditioned air based at least in part on (g).

5. The device of claim 1, wherein the excess routing procedure further includes selecting a second zone of the plurality of inactive zones to receive at least a portion of the excess volume of conditioned air based at least in part on a physical location or orientation of the second zone.

6. The device of claim 1, wherein the excess routing procedure is configured to identify a subset of the plurality of inactive zones that are most likely to trigger a subsequent activation condition to activate the HVAC device, the unoccupied zone being one of the subset, wherein the subset also includes at least a second unoccupied zone and a third unoccupied zone that have an equal difference between the measured quantity and occupied set points for the second unoccupied zone and the third unoccupied zone, and wherein the excess routing procedure further includes:

(i) determining that an airflow demand of the second unoccupied zone is closer to a volume of an unassigned portion of the excess volume of conditioned air than an airflow demand of the third unoccupied zone; and (j) selecting the second unoccupied zone to receive the unassigned portion of the excess volume of conditioned air based at least in part on (i).

7. The device of claim 6, wherein performing the excess routing procedure comprises iteratively performing the excess routing procedure.

8. The device of claim 7, further comprising:

instructing a first group of dampers to open, wherein the first group of dampers is associated with the subset; and instructing a second group of dampers to close, wherein the second group of dampers is associated with a remainder of the plurality of inactive zones that are not part of the subset.

9. The device of claim 6, wherein a cumulative airflow demand of the subset is not less than the volume of excess conditioned air.

10. A non-transitory computer-readable storage medium comprising instructions that, in response to execution, cause a device comprising a processor to perform operations comprising:

determining that a heating, ventilation, and air conditioning (HVAC) device is to be activated to provide a defined volume of conditioned air to at least one active zone of a group of zones, the at least one active zone having satisfied an activation condition to activate the HVAC device, the group of zones also including a plurality of inactive zones that have not satisfied corresponding activation conditions to activate the HVAC device, determining that the HVAC device is to produce an excess volume of conditioned air, wherein the excess volume of conditioned air is representative of the defined volume of conditioned air less a volume that is delivered to the at least one active zone, performing an excess routing procedure to identify one or more of the plurality of inactive zones to receive a distribution of the excess volume of conditioned air, wherein the excess routing procedure includes:

(a) determining that an unoccupied zone of the plurality of inactive zones has a largest difference between a measured quantity and an occupied set point for the unoccupied zone, and (b) selecting the unoccupied zone based at least in part on (a) to receive at least a portion of the excess volume of air.

11. The non-transitory computer-readable storage medium of claim 10, wherein the excess routing procedure further includes:

(c) determining that a second unoccupied zone of the plurality of inactive zones has a smallest difference between the measured quantity and a corresponding unoccupied set point; and (d) selecting the second unoccupied zone to receive at least a portion of the excess volume of conditioned air based at least in part on (c).

12. The non-transitory computer-readable storage medium of claim 10, wherein the excess routing procedure further includes:

(e) determining that a second zone of the plurality of inactive zones has a largest rate of change of the measured quantity; and (f) selecting the second zone to receive at least a portion of the excess volume of conditioned air based at least in part on (e).

13. The non-transitory computer-readable storage medium of claim 10, wherein the excess routing procedure is configured to identify a subset of the plurality of inactive zones that are most likely to trigger a subsequent activation condition to activate the HVAC device, the unoccupied zone being one of the subset.

14. The non-transitory computer-readable storage medium of claim 13, wherein performing the excess routing procedure comprises iteratively performing the excess routing procedure.

15. A method, implemented in a computing device, comprising:

determining that a heating, ventilation, and air conditioning (HVAC) device is to be activated to produce a defined volume of conditioned air to at least one active zone of a group of zones, the at least one active zone having satisfied an activation condition to activate the HVAC device, the group of zones also including a plurality of inactive zones that have not satisfied corresponding activation conditions to activate the HVAC device, determining that the HVAC device is to produce an excess volume of conditioned air, wherein the excess volume of conditioned air is representative of the defined volume of conditioned air less a volume that is to be delivered to the at least one active zone, and performing an excess routing procedure to identify one or more of the plurality of inactive zones to receive a distribution of the excess volume of conditioned air, wherein the excess routing procedure includes:

(a) determining that an unoccupied zone of the plurality of inactive zones has a largest difference between a measured quantity and an occupied set point for the unoccupied zone, and (b) selecting the unoccupied zone based at least in part on (a) to receive at least a portion of the excess volume of air.

16. The method of claim 15, wherein the excess routing procedure further includes:

(c) determining that a second unoccupied zone of the plurality of inactive zones has smallest difference between the measured quantity an unoccupied set point for the second unoccupied zone; and (d) selecting the second unoccupied zone to receive at least a portion of the excess volume of conditioned air based at least in part on (c).

17. The method of claim 15, further comprising:

(e) determining that a second zone of the plurality of inactive zones has a largest rate of change of the measured quantity; and selecting the second zone to receive at least a portion of the excess volume of conditioned air based at least in part on (e).

18. The method of claim 15, wherein the excess routing procedure is configured to identify a subset of the plurality of inactive zones that are most likely to trigger a subsequent activation condition to activate the HVAC device, the unoccupied zone being one of the subset, wherein the subset also includes a second unoccupied zone and a third unoccupied zone that have an equal difference between the measured quantity and occupied set points for the second unoccupied zone and the third unoccupied zone, and wherein the excess routing procedure further includes:

(g) determining that an airflow demand of the second unoccupied zone is closer to a volume of an unassigned portion of the excess volume of conditioned air than an airflow demand of the third unoccupied zone, while not being less than the volume of the unassigned portion; and (h) selecting the second unoccupied zone to receive the unassigned portion of the excess volume of conditioned air based at least in part on (g).

19. The method of claim 18, wherein the subset is determined by iteratively performing the excess routing procedure.

* * * * *